US011577136B2

(12) United States Patent
Reed

(10) Patent No.: US 11,577,136 B2
(45) Date of Patent: Feb. 14, 2023

(54) SPORTS TRAINING DEVICE, SYSTEM, AND METHOD OF USE

(71) Applicant: Sports Innovations, LLC, Perdido, AL (US)

(72) Inventor: Jason Reed, Perdido, AL (US)

( * ) Notice: Subject to any disclaimer, the term of this patent is extended or adjusted under 35 U.S.C. 154(b) by 195 days.

(21) Appl. No.: 16/752,583

(22) Filed: Jan. 24, 2020

(65) Prior Publication Data

US 2021/0228957 A1 Jul. 29, 2021

(51) Int. Cl.
*A63B 69/36* (2006.01)
*A63B 69/00* (2006.01)
*A63B 102/18* (2015.01)

(52) U.S. Cl.
CPC ..... *A63B 69/0002* (2013.01); *A63B 69/0075* (2013.01); *A63B 2069/0008* (2013.01); *A63B 2102/18* (2015.10); *A63B 2208/0204* (2013.01)

(58) Field of Classification Search
CPC ..... A63B 69/0002; A63B 69/0075; A63B 2102/18; A63B 2069/0008; A63B 2208/0204
USPC ..... 473/422, 454, 497
See application file for complete search history.

(56) References Cited

U.S. PATENT DOCUMENTS 2,978,246 A * 4/1961 Van Groningen ..... A63B 63/00 473/456
5,431,145 A * 7/1995 Strait ..... A63B 65/122 124/17
5,830,079 A * 11/1998 Hudson ..... A63B 69/3608 473/272
6,139,450 A * 10/2000 Rivers ..... A63B 69/0002 473/422
6,579,195 B2 * 6/2003 Lamb ..... A63B 69/0002 473/417
7,662,052 B1 * 2/2010 Vidrine ..... A63B 69/0075 473/422
8,784,229 B1 * 7/2014 McCullough ..... A63B 69/3667 473/257
9,757,636 B1 * 9/2017 Schwarz ..... A63B 69/0002
2004/0266565 A1 * 12/2004 Andrews ..... A63B 69/0002 473/453
2012/0040780 A1 * 2/2012 Fournier ..... A63B 69/0075 473/417
2015/0202513 A1 * 7/2015 May, II ..... A63B 69/0057 473/451

(Continued)

*Primary Examiner* — Nini F Legesse
(74) *Attorney, Agent, or Firm* — AdamsIP, LLC

(57) ABSTRACT

A training apparatus for baseball training includes a base and training attachments that may be attached to the base to allow a user to practice a variety of training techniques. The base may be modular so that it has an adjustable width and disassembles into separate components. At least one training attachment is designed to train a batter to properly incorporate thrust into a swinging motion when swinging a baseball bat. The attachment has a pivotally mounted member with a contact element attached to the top end of the member. The member pivots forward and downward when the user's knee contacts the contact element when properly executing a swinging motion. Thus, the training attachment provides direct and immediate feedback to the user regarding the user's batting form. Other training attachments may be used for hitting balls and for pitching to targets strategically placed around a strike zone.

8 Claims, 8 Drawing Sheets

(56) References Cited

U.S. PATENT DOCUMENTS

| | | | | |
|---|---|---|---|---|
| 2015/0283442 | A1* | 10/2015 | Schwarz | A63B 69/0002 473/417 |
| 2016/0361583 | A1* | 12/2016 | Nguyen | A63B 21/068 |
| 2019/0269957 | A1* | 9/2019 | Petrucci | A47B 81/00 |

* cited by examiner

SPORTS TRAINING DEVICE, SYSTEM, AND METHOD OF USE

FIELD OF THE DISCLOSURE

The subject matter of the present disclosure refers generally to a device, system, and method for sports training.

BACKGROUND

Baseball and softball are sports which require a batter to use a bat to hit a ball thrown by a pitcher. The pitcher throws the ball toward the batter as the batter stands adjacent to a home plate. The objective of the pitcher is to throw the ball over a specific area of the home plate called the strike zone without the batter hitting the ball. Conversely, the objective of the batter is to hit the ball thrown by the pitcher into the field of play and then advance to another base. One of the fundamental skills needed to be successful as a batter is the ability to accurately and consistently hit a ball thrown by a pitcher in varying locations within the strike zone. Being able to hit a thrown baseball or softball anywhere within the strike zone is arguably one of the most difficult aspects of hitting to master. Repetitive batting exercises in executing correct batting form is helpful in improving success in batting while teaching players ranging from novices to professionals how to consistently connect with the ball. Similarly, repetitive pitching exercises in executing specific pitches thrown to specific target areas within the strike zone improve success in pitching.

Good batting technique involves interplay between stance, weight shift, and swinging movement. To produce an effective swing, a batter must generate thrust through movement of the batter's body and hips. When swinging the bat, thrust may be generated through the batter incorporating his or her body mass into the swinging motion. By incorporating the batter's body weight into the swing, when the bat makes contact with the pitched ball, the extra body weight of the batter being incorporated into the swing in the form of increased thrust generally causes the ball to travel farther. There are several different components of a proper swing that combine to create proper thrust when swinging. One of these elements is the proper motion of the player's hips and back leg while swinging. With good batting technique, the batter's back leg should generally move toward the plate and bend at the knee as the batter follows through with the swinging motion. This motion is one of the body motions that may ensure that the batter's momentum continues forward in the direction of the swing and is not discharged as wasted energy.

In presently used hitting practice methods, players typically rely on feedback from a coach or other observer in visually evaluating the batter's swinging motion, including movement of the batter's leg. Conventional training tools for improving a batter's swing generally do not provide the batter with direct feedback relating to the batter's back leg and general body movement as the batter swings a bat. Accordingly, a need exists in the art for a training tool that can be used to train a batter in batting technique to help the batter consistently generate thrust when swinging a bat. Further, a need exists in the art for a training tool that can give direct swing-motion feedback to the player. In addition, a need exists in the art for a training tool for batting technique that can also be utilized for training in hitting balls in varying areas of the strike zone, as well as training in pitching accuracy, which would provide economic and practical efficiency to players desiring skill level advancement in the game.

SUMMARY

In one aspect, a sports training apparatus and a method of using the apparatus are provided. The apparatus may be utilized for training athletes in proper technique when executing a swinging motion, such as swinging a baseball bat to hit a ball pitched to the athlete. In particular, the apparatus may be utilized to train a player in proper weight transfer technique when executing a swinging motion. The apparatus comprises a base configured to support the apparatus in an upright position on a ground surface and a training attachment mounted on the base. The training attachment comprises an elongated attachment member pivotally mounted on a hinge at a proximal end. The attachment member also has a contact element attached to a distal end. The training attachment is configured to retain the attachment member in a generally vertical position when the attachment member is moved to the vertical position by a user. The attachment member is pivotable in a downward direction from the vertical position and preferably at least down to a horizontal position. In a preferred embodiment, the attachment member is generally pivotable downward from the vertical position to a generally horizontal position only within a defined angle of rotation and only downward in one pivot direction.

To use the apparatus, the attachment member is first moved into the vertical position by the user. The user then stands over the apparatus in a batting stance with the user's front leg positioned on a front side of the contact element and the user's back leg positioned on a back side of the contact element. The contact element is positioned vertically when the attachment member is in the vertical position and perpendicularly to the direction of the pivoting motion of the attachment member. In a preferred embodiment, the contact element is a generally flat element with a sufficiently large surface area for a portion of the user's leg to make contact with the contact element and cause the attachment member to pivot downward from the vertical position, and preferably to the horizontal position, upon a contacting force being applied by the user's knee to the contact element during the swinging motion. The apparatus is positioned relative to the user such that the user's back knee contacts one side of the generally flat contact element. The contact element is preferably covered in padding so as to not cause discomfort to the user's knee or leg when making contact with the contact element. The contact element preferably has a rectangular or circular shape, though other suitable shapes may be utilized. To horizontally align the contact element with the knee of the user's back leg when in the batting stance, the elongated attachment member preferably has an adjustable length such that the height of the contact element above the base is adjustable. Once the user is properly positioned relative to the apparatus, the user may then swing a bat, which may or may not be swung at a ball that has been pitched to the batter, as desired. If the user's swinging form is proper, the user's knee on his back leg positioned behind the contact element will contact the contact element and cause the attachment member to pivot forward and downward from the vertical position as the user follows through with the swinging motion. Thus, the training apparatus will provide immediate feedback to the user as to whether the user has executed a proper swinging motion. If the contact element does not fall down in a forward direction, the user will immediately know that his swinging motion was not ideal for generating maximum thrust to maximize hitting distance. Conversely, if the contact element falls down in a forward direction, the user will immediately know that he has executed a proper swinging motion. After executing the swing, the user may simply manually move the attachment member and contact element back to the vertical position and execute another swing to repetitively practice proper swinging motion.

In a preferred embodiment, the apparatus is versatile and provides for the attachment of multiple different types of training attachments. The base preferably has a plurality of attachment elements each configured to removably secure a training attachment to the base so that one or more training attachments may be secured to the base at any time for use in training athletes. In a preferred embodiment, the training apparatus further comprises a second training attachment configured to removably secure to an attachment element. The second training attachment comprises a generally vertical attachment member secured to one attachment element at a proximal end and having a tee attached to a distal end. The tee is configured to support a ball on the tee so that a user can practice hitting the ball off the tee. In a preferred embodiment, the apparatus may have three spaced attachment elements with three respective training attachments having tees for supporting a ball so that the apparatus may be used with all three tees at once. In this embodiment, the base may be configured to fit over a standard sized home plate used in baseball or softball so that the middle tee positions a ball over the center of the plate, and the remaining two tees position a ball over the inside part of the plate and the outside part of the plate, respectively, depending on whether the batter is left-handed or right-handed. Thus, the apparatus may then be used in hitting drills to practice hitting balls over different parts of the plate as a batter typically sees during a baseball or softball game while the batter remains in the same batting position relative to the plate and without the necessity of moving the apparatus.

In a preferred embodiment, the training apparatus may further comprise a third training attachment configured to removably secure to an attachment element. The third training attachment comprises a generally vertical attachment member secured to one attachment element at a proximal end and having a horizontal target positioning member attached to a distal end. The target positioning member has a plurality of targets attached to the target positioning member and preferably has two targets attached to each of two opposing ends of the target positioning member for a total of four targets for a pitcher to attempt to hit throwing a baseball. In this embodiment, the base may be positioned over home plate so that the four targets are positioned over four respective areas of the strike zone: high and inside, low and inside, high and outside, and low and outside, for example, depending on whether the pitcher is throwing to a left-handed or a right-handed batter. The apparatus may then be used by pitchers to practice executing a variety of pitches intended to cross the plate at various areas within the strike zone.

Each of the training attachments of the present training apparatus is configured to achieve a specific goal in baseball and softball training. Thus, the present apparatus may be utilized to achieve multiple training goals with efficiency and convenience to the player.

In a preferred embodiment, the base is modular and the width of the base is adjustable. In this embodiment, the base preferably comprises an elongated base member comprising a first tube and a second tube, wherein the first tube has a cross-sectional area smaller than the cross-sectional area of the second tube, and wherein the first tube is slidably disposed within the second tube such that the length of the base member is adjustable. The base further comprises a first support member having a first connection element configured to removably secure the first support member to the first tube at one end of the base member and a second support member having a second connection element configured to removably secure the second support member to the second tube at an opposing end of the base member. The apparatus further comprises at least one attachment element, and preferably a plurality of attachment elements, integrally formed with the base member and configured to removably secure a training attachment to a top side of the base member. Any of the three training attachments described above may be secured to any one of the respective attachment elements. In a preferred embodiment, the training apparatus comprises three attachment elements so that three training attachments may be removably secured to the apparatus at one time. Two of the attachment elements are preferably integrally formed with the base member, and one of the attachment elements is preferably integrally formed with one of the support members. Each support member preferably has two opposing support legs extending downwardly from each of the first and second support members. The opposing support members provide stability to the training apparatus so that the apparatus does not fall over while being used for training in batting or pitching.

The foregoing summary has outlined some features of the system and method of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purpose of the system and method disclosed herein. Those skilled in the pertinent art should also realize that such equivalent designs or modifications do not depart from the scope of the system and method of the present disclosure.

DESCRIPTION OF THE DRAWINGS

These and other features, aspects, and advantages of the present disclosure will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components. As used herein, the term "removably secured" or grammatical equivalents thereof indicates that a component may be secured to a second component and then detached from the second component without the use of a specialized tool and without damaging either component.

The present device and methods relate generally to sports training equipment. Particularly, the present training apparatus relates to batting training for purposes of teaching proper stance and movement technique when executing a swinging motion, such as the motion a batter makes when swinging a baseball bat. In alternative embodiments, the present training apparatus may be configured for use in training to execute a swinging motion common to other sports, such as a golf swing. The present training apparatus also relates to baseball and softball pitching training by providing targets to be struck by balls thrown by a pitcher, as well as batting practice by providing tees to support balls to be hit by batters during batting drills.

Figure 1:
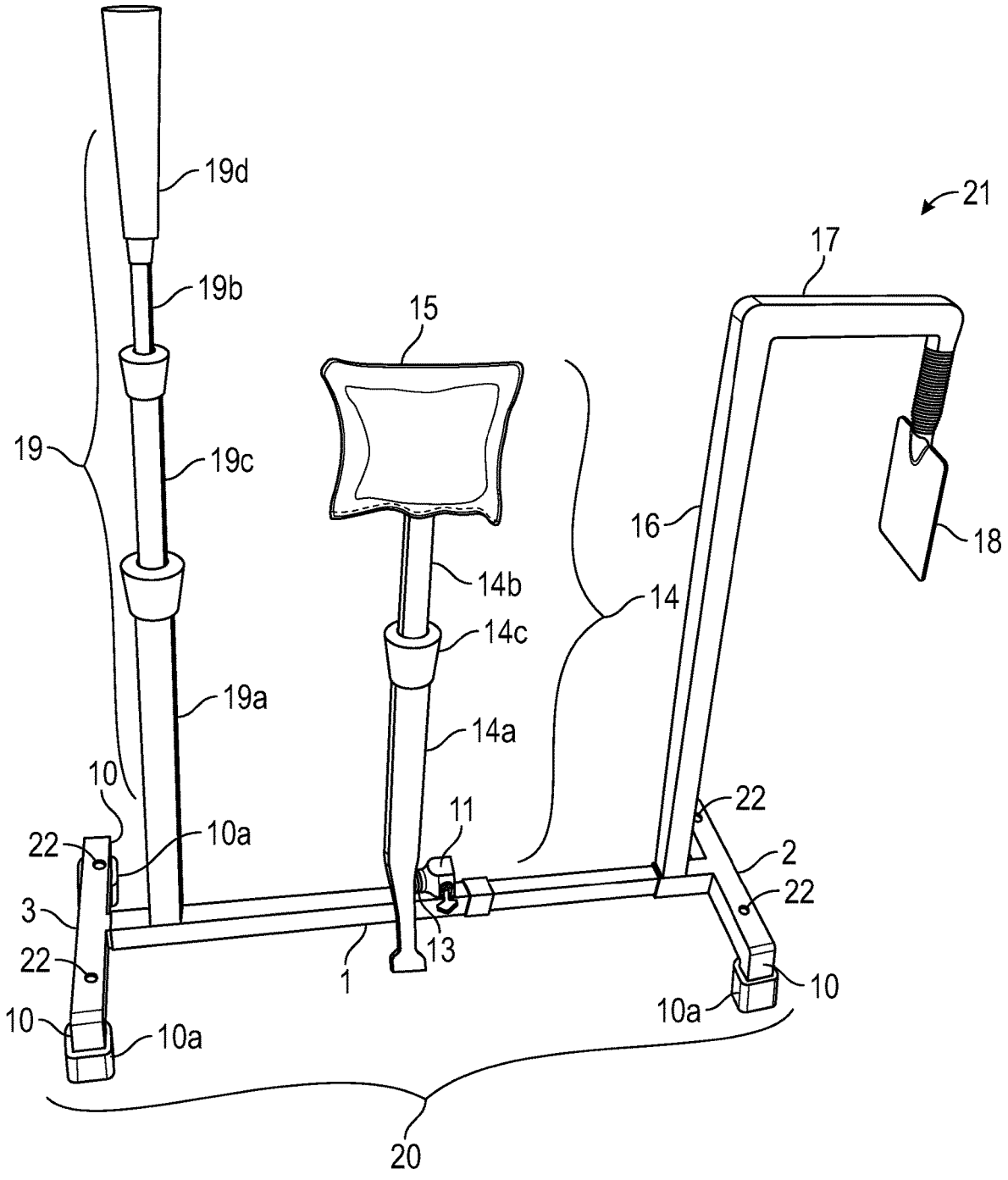
FIG. 1 is a perspective view of a sports training device in accordance with the present disclosure.

Turning now to the figures, FIGS. 1-11 illustrate preferred embodiments of a sports training apparatus. In a preferred embodiment, the present apparatus is versatile so that it may be used for a variety of training techniques particularly related to training in batting and pitching for baseball or softball. The apparatus preferably comprises a plurality of different types of training attachments that may be secured to and removed from the apparatus as desired for different types of training techniques. For ease of illustrating the versatility of the apparatus, FIG. 1 shows the apparatus with three different types of training attachments 14, 19, 21, though these different types of attachments are generally used for different types of training and thus not used at the same time. The first training attachment 14 is generally used to practice the proper technique for executing a swinging motion. The second training attachment 19 provides a tee for hitting a ball during hitting drills. And the third training attachment 21 provides a target 18 for a pitcher to hit with a ball when practicing pitching.

Figure 3:
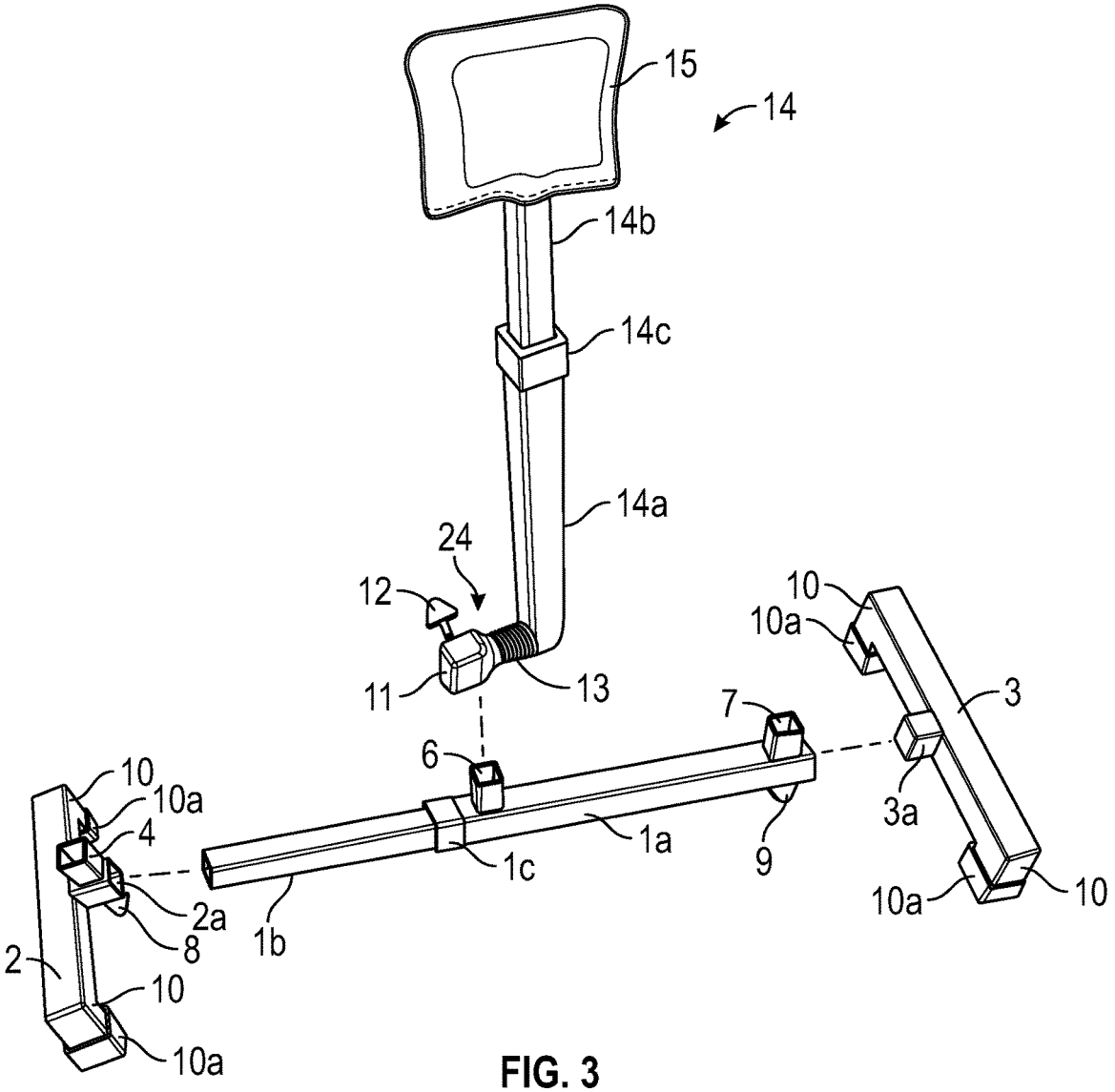
FIG. 3 is an exploded view of a sports training device in accordance with the present disclosure.
Figure 4:
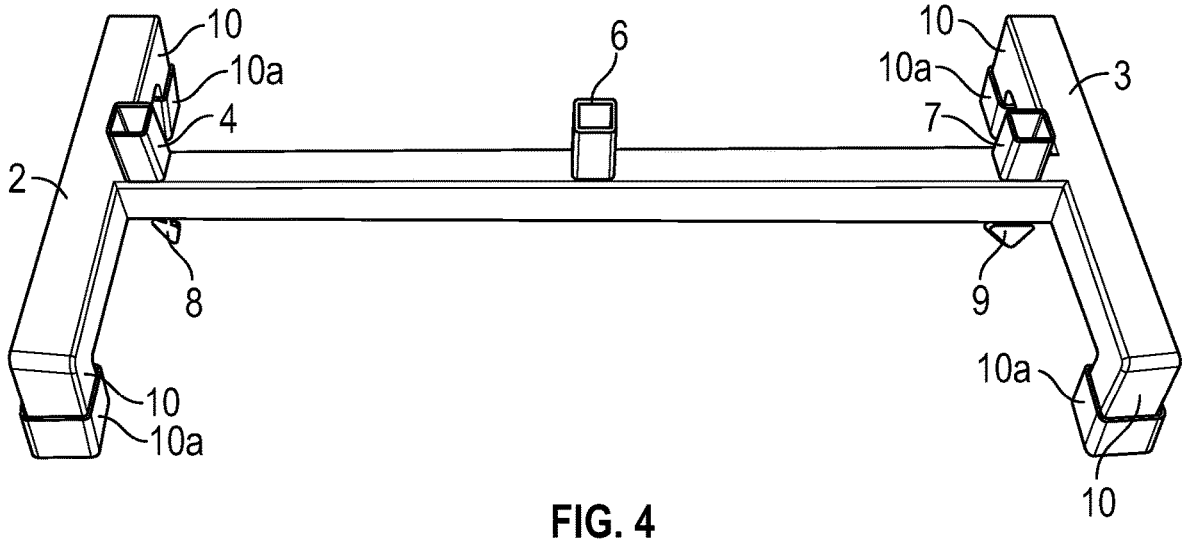
FIG. 4 is a perspective view of components of a sports training device in accordance with the present disclosure.
Figure 8:
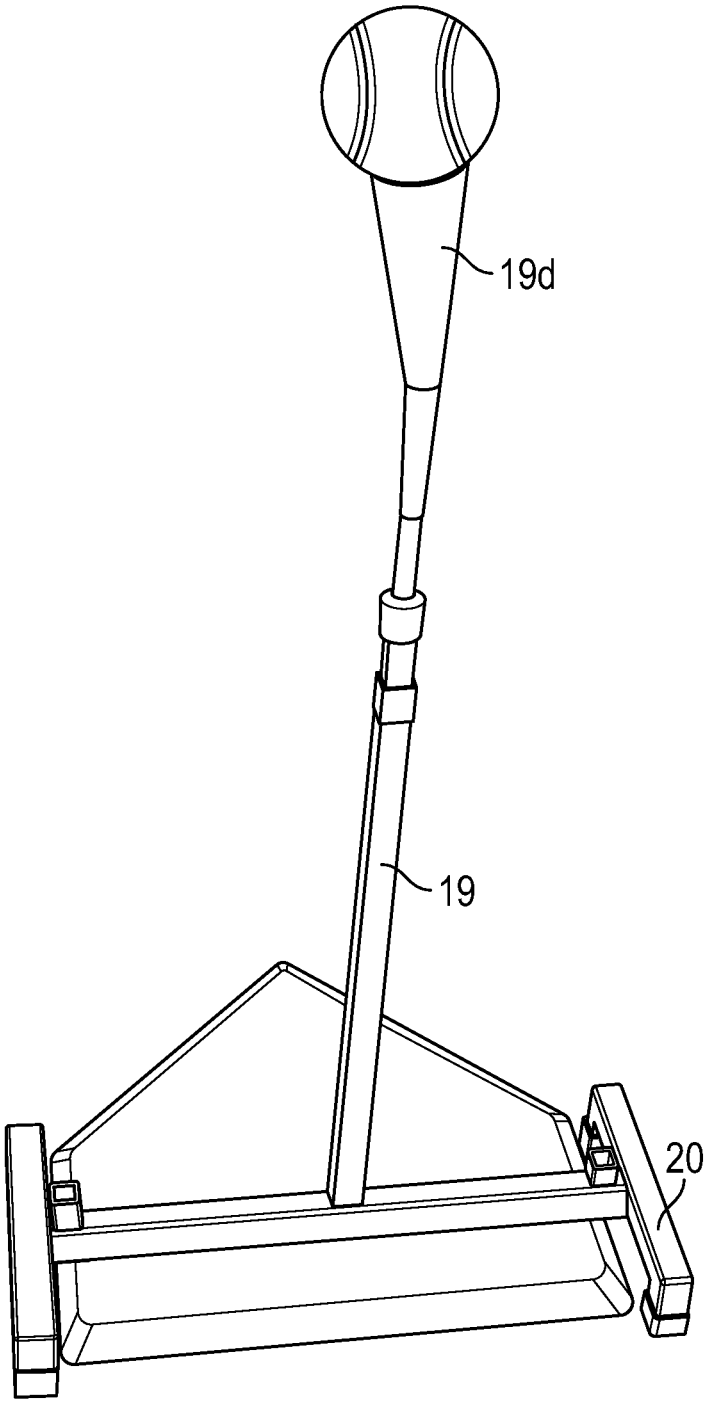
FIG. 8 is a perspective view of a sports training device in accordance with the present disclosure.

As shown in FIG. 1, in a preferred embodiment, the apparatus comprises a base 20 and at least one of a first training attachment 14, a second training attachment 19, and a third training attachment 21. In a preferred embodiment, as shown in FIGS. 1 and 3, the base 20 is modular and the width of the base is adjustable. In this embodiment, the base 20 preferably comprises an elongated base member 1 comprising a first tube 1*b* and a second tube 1*a*, wherein the first tube has a cross-sectional area smaller than the cross-sectional area of the second tube, and wherein the first tube 1*b* is slidably disposed within the second tube 1*a* such that the length of the base member 1 is adjustable. In an alternative embodiment, as shown in FIGS. 4 and 8, the base 20 may be an integrally formed base that does not have removable or adjustable components. However, a modular base that disassembles into separate components may be advantageous, such as for purposes of ease of storage or travel. The apparatus further comprises a first support member 2 having a first connection element 2*a* configured to removably secure the first support member 2 to the first tube 1*b* at one end of the base member 1 and a second support member 3 having a second connection element 3*a* configured to removably secure the second support member 3 to the second tube 1*a* at an opposing end of the base member 1. Each support member preferably has two opposing support legs 10 extending downwardly from each of the first and second support members. The opposing support members 2, 3 provide stability to the training apparatus so that the apparatus does not fall over while being used for training in batting or pitching. The support legs 10 preferably have rubber caps 10*a* to help reduce movement or shifting of the apparatus when in use. In addition, in a preferred embodiment, each of the support members 2, 3 may have one or more openings 22 extending through the support member through which one or more stakes (not shown) may be inserted and then pushed into a ground surface on which the apparatus rests to provide additional support to reduce movement of the apparatus during use.

Figure 10:
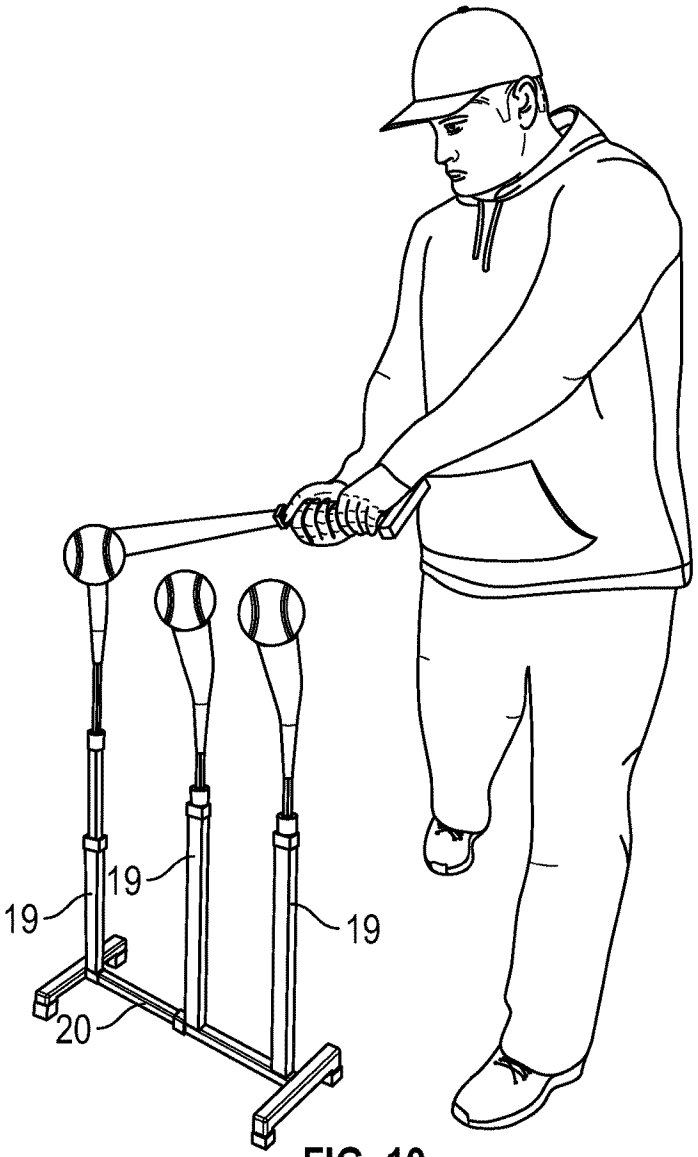
FIG. 10 is a perspective view of a sports training device in use by a right-handed batter while training to hit a baseball in accordance with the present disclosure.
Figure 9:
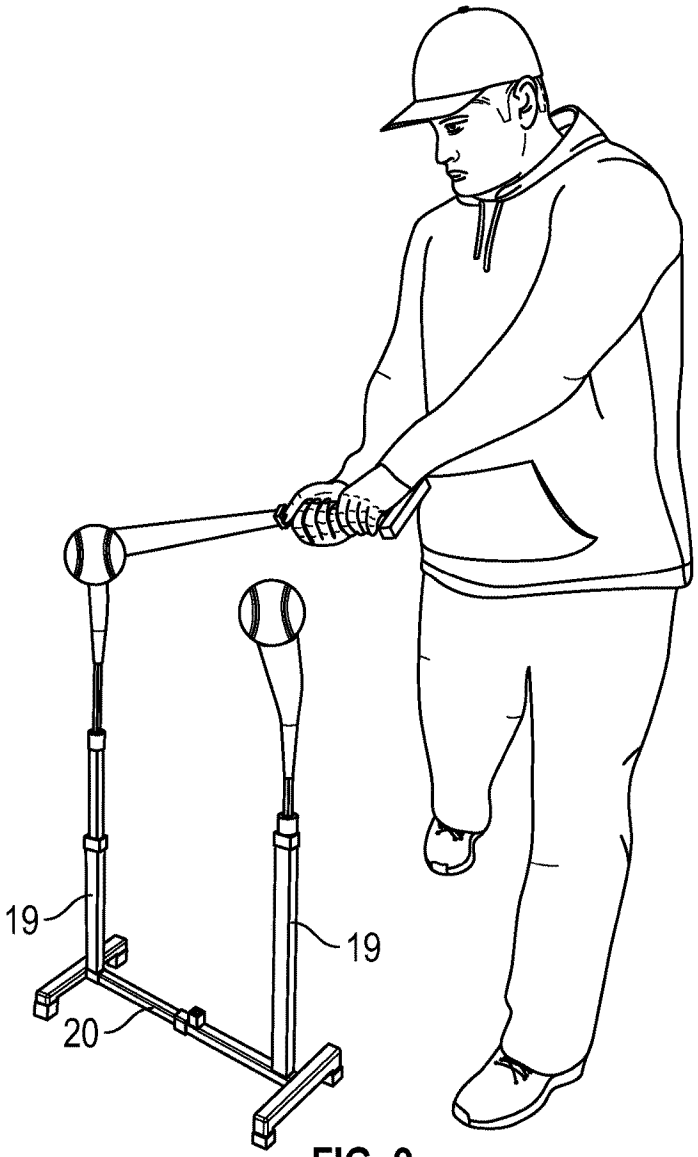
FIG. 9 is a perspective view of a sports training device in use by a right-handed batter while training to hit a baseball in accordance with the present disclosure.
Figure 11:
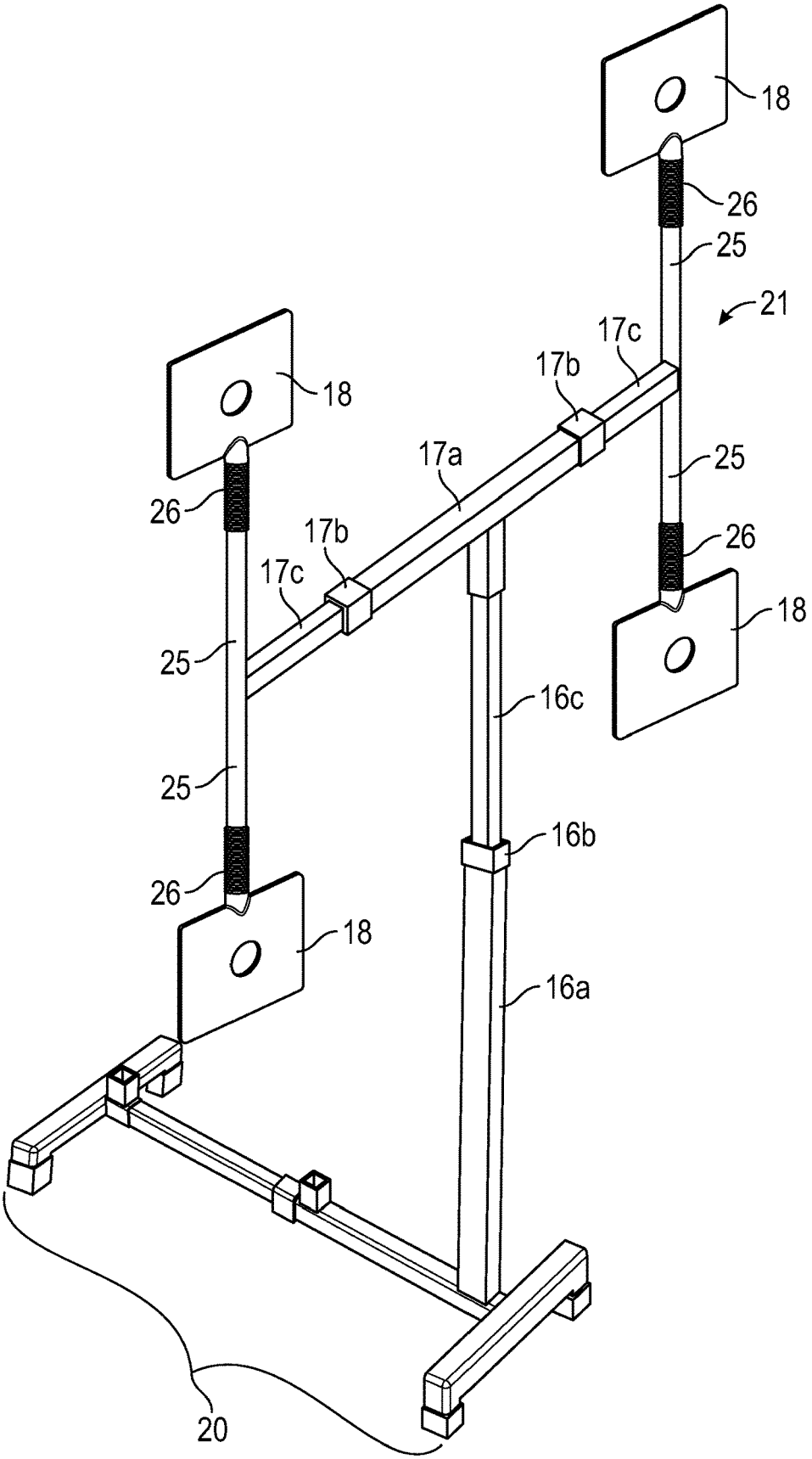
FIG. 11 is a perspective view of a sports training device in accordance with the present disclosure.

The apparatus further comprises at least one attachment element, and preferably a plurality of attachment elements 4, 6, 7, configured to removably secure a respective training attachment to a top side of the base member 1 or to one of the support members 2, 3. Any of the three training attachments 14, 19, 21 described herein may be secured to any one of the respective attachment elements 4, 6, 7. In a preferred embodiment, the training apparatus comprises three spaced attachment elements 4, 6, 7 so that up to three training attachments may be removably secured to the apparatus at one time. Each attachment element 4, 6, 7 is integrally formed with a respective one of the base member 1 and optionally with one or both of the support members 2, 3. In a preferred embodiment, two of the attachment elements 6, 7 are integrally formed with the base member 1, and one of the attachment elements 4 is integrally formed with the first support member 2. FIG. 1 illustrates the training apparatus having each respective training attachment secured to a particular attachment element of the assembled base 20. The configuration of training attachments shown in FIG. 1 represents only one possibility of attachments. Each respective attachment element of the base 20 is configured to secure any one of the training attachments to the base. For example, FIG. 3 shows a first training attachment 14 being secured to center attachment element 6, while FIG. 8 shows a second training attachment 19 secured to center attachment element 6. In addition, FIG. 9 shows two of the training attachments 19 having tees secured to attachment elements 4 and 7, respectively, while FIG. 10 shows three of these same attachment elements 19 secured to each respective attachment element. FIG. 11 shows the third training attachment 21 secured to attachment element 7. Thus, the configuration of attachment elements in the present training apparatus gives great flexibility to the user for options in how to train in both batting and pitching while using a single device.

In a preferred embodiment, the first tube 1*b* and the second tube 1*a* each have a substantially square cross-sectional shape, which may help to ensure rigidity of the components and reduce the possibility of the components of the apparatus shifting, though in other embodiments the tubes may have other cross-sectional shapes, such as a circular shape. The tubes are preferably constructed of steel, though they may be constructed of other materials, such as aluminum, iron, alloy composite, or any other suitable material. In a preferred embodiment, the length of the elongated base member 1 is adjustable by telescopically sliding the first tube 1*b* within the second tube 1*a*. To facilitate the telescoping tubes, the first tube 1*b* has a cross-sectional area slightly smaller than the cross-sectional area of the second tube 1*a*. The ability of the first tube 1*b* to telescopically slide into second tube 1*a* allows for easy breakdown for storage of the apparatus as well as ease of transport. In an alternative embodiment, the center of half of the body of the elongated base member 1 may be hollow with a bottom portion cut out so that the first tube 1*b* of the elongated base member 1 may be folded into the second tube 1*a* at a pivot point.

To assemble the base 20 in the preferred modular configuration, the elongated base member 1 is secured to the first support member 2 at one end of the first tube 1*b* and the second support member 3 at an opposing end of the second tube 1*a*. In a preferred embodiment, both the first support member 2 and the second support member 3 also comprise steel square tubing to help ensure rigidity of the components and reduce the possibility of the components of the apparatus shifting. It is understood that the support members may comprise any material providing sufficient rigidity and may be in any other suitable shape, such as a circular shape. The base member 1 preferably comprises a retaining device 1*c* configured to slidably retain the first and second tubes in a fixed position relative to each other. The retaining device 1*c* may preferably comprise a piece of rubber or similar material that fits over portions of each tube and creates a friction force between the rubber material and each of the tubes to prevent the tubes from easily moving relative to each other. In other embodiments, the retaining device 1*c* may comprise a piece of material that wedges into an annular space between the two tubes to prevent axial movement of the tubes. The retaining device 1*c* may have a square shape, as shown in FIG. 1, when used with square tubes, or may optionally have a circular shape if circular tubes are utilized, in which case the retaining device may be rotated to tighten or loosen the fit between tubes.

Figure 2A:
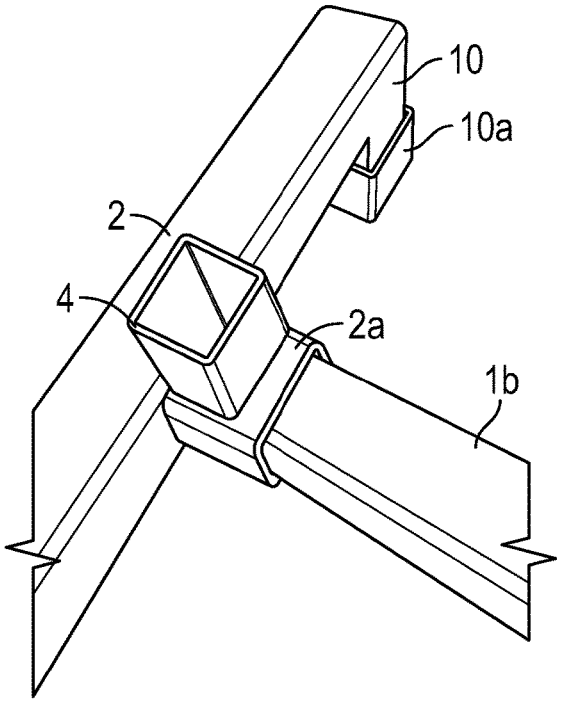
FIG. 2A is a partial perspective view of a sports training device in accordance with the present disclosure.
Figure 2B:
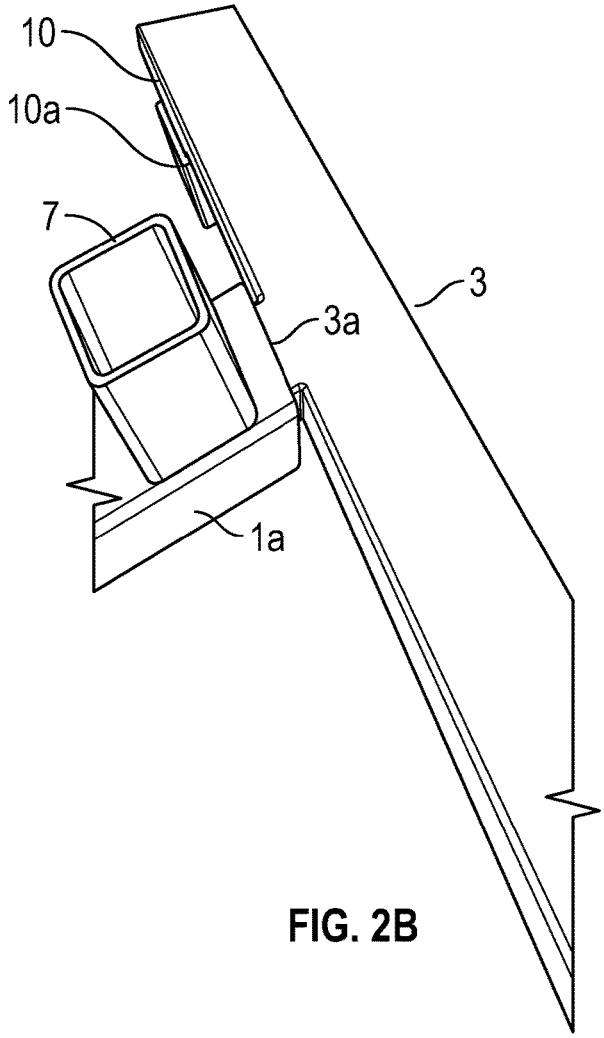
FIG. 2B is a partial perspective view of a sports training device in accordance with the present disclosure.

In a preferred embodiment, the first support member 2 comprises a first connection element 2*a* preferably having a cross-sectional area greater than the cross-sectional area of the first tube 1*b* of the elongated base member 1 such that the first tube 1*b* can be inserted into the connection element 2*a*, as shown in FIG. 2A. Thus, the first connection element 2*a* preferably has a square cross-sectional shape and a hollow interior and is sized to receive the first tube 1*b* therein. In a preferred embodiment, the second support member 3 comprises a second connection element 3*a* preferably having a cross-sectional area smaller than the cross-sectional area of the second tube 1*a* of the elongated base member 1 such that the second tube 1*a* can slide over the connection element 3*a*, as shown in FIG. 2B. Thus, connection element 3*a* preferably has a substantially square cross-sectional shape, and the second tube 1*a* preferably has a hollow interior and is sized to receive the second connection element 3*a* therein. The first connection element 2*a* is preferably positioned at the center of the first support member 2, and the second connection element 3*a* is preferably positioned at the center of the second support member 3. In other alternative embodiments, the first support member 2 may have a connection element 2*a* with a cross-sectional area smaller than said first tube 1*b* or the second support member 3 may have a connection element 3*a* with a cross-sectional area larger than the cross-sectional area of the second tube 1*a*. In an alternative embodiment, the connections between the elongated base member 1 and the first support member 2 and second support member 3 may each comprise compatible threaded connections so that the support members may be threaded onto the base member to secure the components together. In this embodiment, the base member 1 may have a circular cross-section area and the connection elements 2*a* and 3*a* may have either male or female threaded sections.

In a preferred embodiment, the training apparatus further comprises a fastener 8, 9 positioned at each respective end of the base member 1, as best seen in FIGS. 3 and 4, wherein each fastener is configured to respectively secure the first support member 2 to the first tube 1*b* and the second support member 3 to the second tube 1*a*. Each fastener 8, 9 preferably comprises a thumb bolt or similar threaded fastener that may be used to secure connection elements 2*a* and 3*a* to the first tube 1*b* and the second tube 1*a*, respectively, by tightening the thumb bolt. The connection elements 2*a* and 3*a* may have an opening having female threads through which each fastener 8, 9 may be inserted and threaded to tighten and to loosen the connection between the connection elements and tubes 1*a* and 1*b*. Alternative embodiments of fasteners 8 and 9 may utilize other locking or securing mechanisms. Once assembled, the combination of the base member 1 and support members 2 and 3 that form the assembled base 20 of the training apparatus preferably has an I-shape, as shown in FIGS. 1 and 4.

Once the base 20 of the training apparatus has been assembled, the apparatus may then be placed directly on a ground surface and in some embodiments may be placed directly over the home plate, depending on the intended use. The base 20 is preferably sized to fit directly over a standard sized home plate, which is 17 inches wide, as shown in FIG. 8, or the width of the base 20 may be adjusted to fit over home plate. The user may then secure one or more desired training attachments 14, 16, 19 to the base 20 and initiate training in either batting or pitching, depending on the attached training attachment.

In a preferred embodiment, the plurality of attachment elements 4, 6, 7 are equally spaced apart so that one attachment element 6 is positioned in a generally central location along the length of the base member 1 when the base 20 is placed directly over the home plate so that attachment element 6 is centered over the plate, though the positioning of attachment element 6 may be changed if the length of the base member 1 is adjusted. Further, attachment elements 4 and 7 are preferably positioned near the ends of the base member 1 where the base member 1 is secured to each of the support members 2 and 3. In a preferred embodiment, as best seen in FIG. 3, the first support member 2 has one integrally formed attachment element 4 configured to removably secure a training attachment to a top side of the first support member 2, and the second support member 3 has a top side devoid of an attachment element for attaching training attachments. In this embodiment, the second tube 1*a* of the base member 1 preferably has one integrally formed attachment element 7 positioned substantially near one end of the base member. This positioning of attachment elements is preferred whether the base 20 is modular or an integrally formed base that does not have removable or adjustable modular components. In a preferred embodiment, each of the attachment elements 4, 6, 7 comprises a short length of substantially square steel tubing, which may have a hollow interior.

Figure 5B:
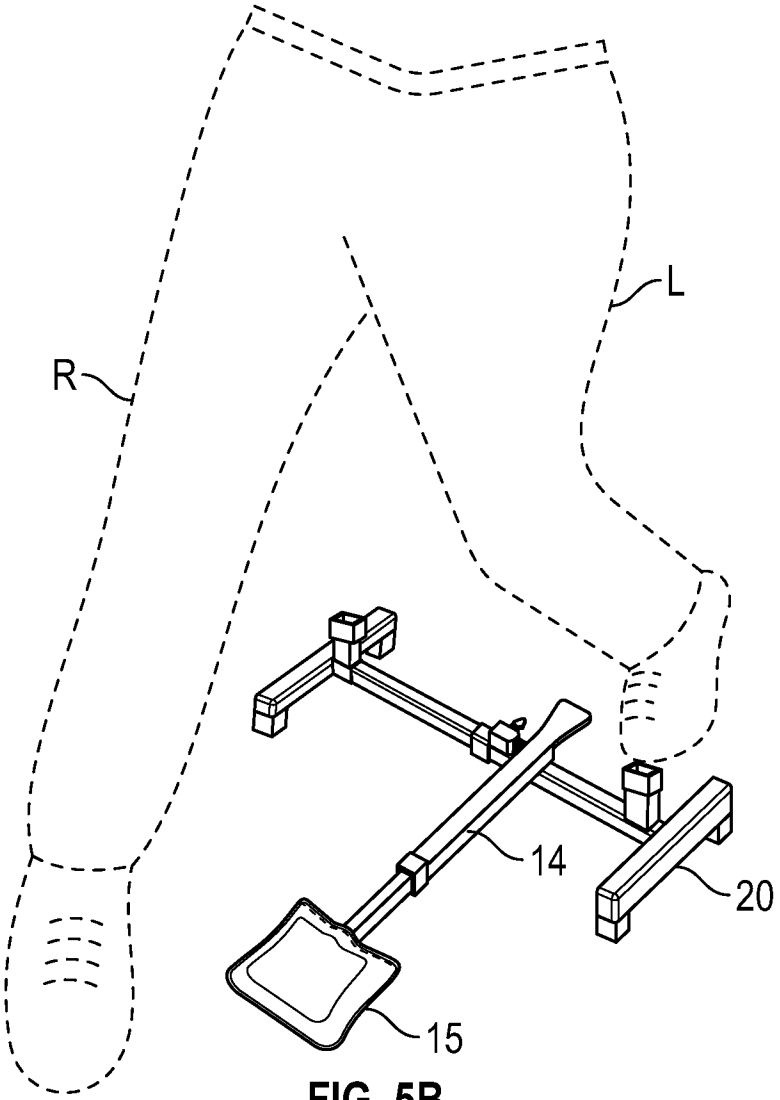
FIG. 5B shows a perspective view of a sports training device in use by a left-handed batter while training to hit a baseball in accordance with the present disclosure.
Figure 5A:
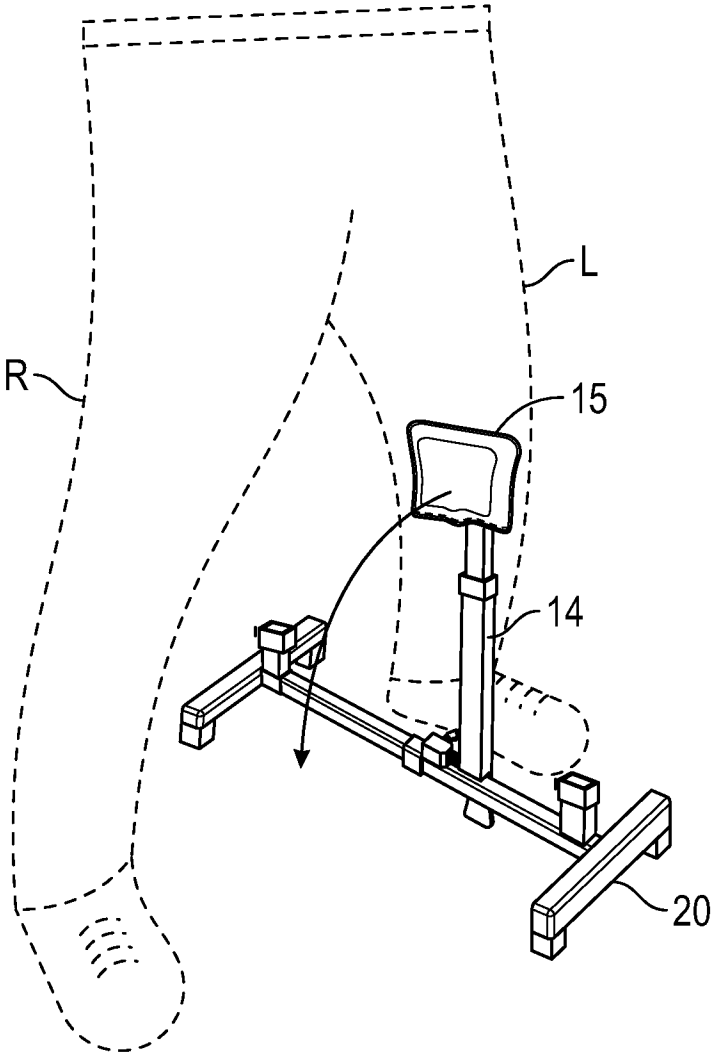
FIG. 5A shows a perspective view of a sports training device in use by a left-handed batter while training to hit a baseball in accordance with the present disclosure.

Each of the attachment elements 4, 6, 7 is configured to removably secure a training attachment 14, 19, 21 to the attachment element. The training apparatus preferably comprises three different types of training attachments as shown in FIG. 1. As best seen in FIGS. 5A and 5B, the apparatus preferably comprises a first training attachment 14 mounted on the base 20 for training in executing a swinging motion, such as the swinging motion of swinging a baseball bat to hit a baseball or softball. Preferably, the first training attachment 14 is configured to removably secure to one of the attachment elements 4, 6, or 7, as illustrated in FIG. 3. In an alternative embodiment, the first training attachment 14 may be permanently mounted on the base 20 such that it cannot be removed from the base 20, which may be a modular base or an integrally formed base that does not have removable or adjustable components.

The first training attachment 14 comprises an elongated attachment member 14*a* pivotally mounted on a hinge 24 at a proximal end of the attachment member 14*a*. The training attachment 14 further comprises a contact element 15 that contacts the user's knee when executing a swinging motion. In a preferred embodiment, the attachment member has an adjustable length such that the height of the contact element 15 above the base 20 is adjustable to accommodate different users. The height of the contact element 15 may be adjusted so that the contact element 15 is horizontally aligned with the knee of the user's back leg, as shown in FIG. 5A. The attachment member preferably comprises two telescoping tubes 14*a* and 14*b* for height adjustment, as well as for ease of breakdown and transport of the apparatus. The training attachment 14 preferably also comprises a retaining device 14*c* configured to slidably retain the telescoping tubes 14*a* and 14*b* in a fixed position relative to each other once the height of the contact element 15 has been adjusted for a specific user. The telescoping tubes 14*a* and 14*b* may have a square cross-sectional shape, as shown in FIG. 3, or alternatively a circular cross-sectional shape, as shown in FIG. 1. In an alternative embodiment, the attachment member may comprise a single elongated tube of a fixed length that is not adjustable.

The contact element 15 is attached to a distal end of the uppermost telescoping tube 14*b* of the elongated attachment member. The training attachment 14 is configured to retain the attachment member 14*a* in a generally vertical position when the attachment member 14*a* is moved to the vertical position, as shown in FIG. 5A, such that the attachment member 14*a* rest in an upright position and does not pivot downward without the application of force. The attachment member 14*a* is pivotable in a downward direction from the vertical position, as shown in FIG. 5B. The attachment member 14*a* preferably pivots downward from the vertical position to a generally horizontal position, though the attachment member 14*a* may optionally not pivot all the way to the horizontal position. Alternatively, the attachment member 14*a* may pivot beyond the horizontal position such that the attachment member 14*a* may be angled downward slightly, depending on the distance between the ground surface and the hinge 24, such that the contact element 15 touches the ground surface when pivoting downward. To retain the attachment member 14*a* in the vertical position, the first training attachment 14 may include a stopper 14*d* that contacts the base member 1 to aid in keeping the attachment member 14*a* and 14*b* as well as the contact element 15 in an upright, vertical position. The stopper 14*d* may also prevent the attachment member 14*a* from pivoting backward so that the attachment member 14*a* is generally pivotable in a downward direction from the vertical position only within a defined angle of rotation, which may preferably be defined by the stopper 14*d* in one direction and by the ground surface upon which the base 20 rests when using the training apparatus in the opposite direction. In one embodiment, the stopper 14*d* may have a support foot facing downward and angled in such a way as to act upon the ground when the first training attachment 14 is positioned upright in order to provide support to the training attachment 14 to keep it in an upright, vertical position when using the apparatus.

To use the apparatus with the second training attachment 14, the attachment member 14*a* is first moved into the vertical position by the user, as shown in FIG. 5A. The user then stands over the apparatus in a batting stance with the user's front leg positioned on a front side of the contact element 15 and the user's back leg positioned on a back side of the contact element 15, as also shown in FIG. 5A. The contact element 15 is positioned vertically when the attachment member 14*a* is in the vertical position and perpendicularly to the direction of the pivoting motion of the attachment member. In a preferred embodiment, the contact element 15 is a generally flat element with a sufficiently large surface area for a portion of the user's leg, which is preferably the user's knee, to make contact with the contact element 15 and cause the attachment member 14*a* to pivot from the vertical position to the horizontal position upon the force applied by the user's knee to the contact element 15 during the swinging motion. The apparatus is positioned relative to the user such that the user's back knee contacts one side of the generally flat contact element 15. The contact element 15 is preferably covered in padding so as to minimize impacts on the user's knee and not cause discomfort to the user's knee or leg when making contact with the contact element 15. The padding may also lessen vibrations in the apparatus caused by the user's knee contacting the contact element. The contact element 15 preferably has a rectangular or circular shape, though other suitable shapes may be utilized. Before using the apparatus for training, the height of the elongated attachment member 14*a* and 14*b* is preferably adjusted to horizontally align the contact element 15 with the knee of the user's back leg. Once the user is in a batting stance and is properly positioned relative to the apparatus, the user may then swing a bat, which may or may not be swung at a ball that has been pitched to the batter, as desired. If the user's swinging form is proper, the user's knee on his back leg positioned behind the contact element 15 will contact the contact element 15 and cause the attachment member 14*a* to pivot forward and downward from the vertical position as the user follows through with the swinging motion, as shown in FIG. 5B. Thus, the training apparatus will provide immediate feedback to the user as to whether the user has executed a proper swinging motion. If the contact element 15 does not pivot downward in a forward direction, the user will immediately know that his swinging motion was not ideal for generating maximum thrust to maximize hitting distance. Conversely, if the contact element 15 does pivot downward in a forward direction, the user will immediately know that he has executed a proper swinging motion. After executing the swing, the user may simply manually move the attachment member 14*a* and contact element 15 back to the vertical position and execute another swing to repetitively practice proper swinging motion. Optionally, the user may simply step on the edge of the stopper 14*d* with his or her foot to cause the attachment member 14*a* to pivot upward back to the vertical position.

FIGS. 5A and 5B illustrate the apparatus being used by a left-handed batter, though the apparatus may also be used by right-handed batters. When used by a left-handed batter, the user's right leg R is the front leg that is positioned on the front side of the contact element 15, and the user's left leg L is the back leg that is positioned on the back side of the contact element 15. If used by a right-handed batter, the positioning of the user's right and left legs relative to the contact element 15 would be reversed. When the user and apparatus are positioned as shown in FIG. 5A, as the user twists his or her body to execute a swinging motion, the user's left leg L should bend at the knee as the knee comes forward slightly and twists downward enough to contact the padded contact element 15, thereby causing the attachment member 14*a* to pivot away from the user and downward toward the ground. This set of actions gives the user direct feedback on posture and technique when swinging. If the knee of the user does not contact the contact element 15 with enough force to cause the attachment member 14*a* to pivot forward and downward, the user must then adjust his or her position and/or swing technique to cause the attachment member 14*a* to pivot forward when executing a swinging motion.

Figure 6:
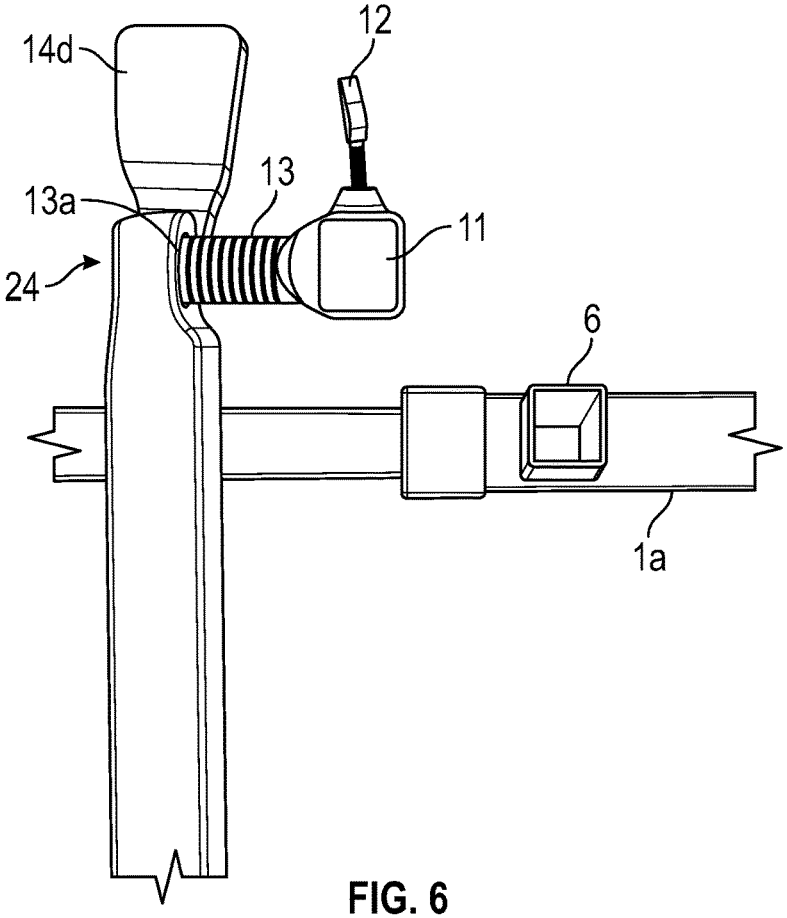
FIG. 6 is a partial perspective view of components of a sports training device in accordance with the present disclosure.
Figure 7:
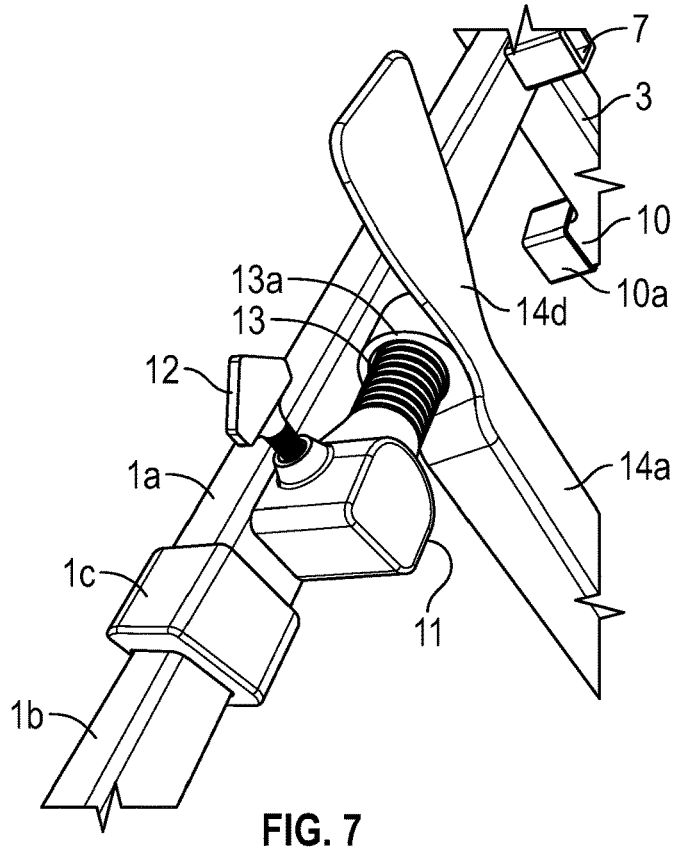
FIG. 7 is a partial perspective view of components of a sports training device in accordance with the present disclosure.

FIGS. 6 and 7 illustrate a preferred embodiment of the hinge 24. FIG. 6 shows the hinge 24 before securing the first training attachment 14 to the base 20, and FIG. 7 shows the hinge 24 with the first training attachment 14 secured to the base 20 and pivoted downward. In a preferred embodiment, the hinge 24 comprises a threaded member 13 having male threads that correspond to female threads in a threaded opening 13*a* into which the threaded member 13 may be inserted and threaded into. The male and female threads of the threaded member 13 and the threaded opening 13*a* should be sized relative to each other such that the attachment member 14*a* will freely pivot about the hinge 24 in a downward direction upon application of force by the user's knee to the contact element 15 with an amount of force typically generated by a user through knee contact produced when executing a swinging motion. The hinge 24 should provide a small amount of resistance between two sets of threads just sufficient enough to keep the attachment member 14*a* from inadvertently pivoting downward from the vertical position without the user contacting the contact element 15. However, the attachment member 14*a* should pivot back and forth about the hinge 24 easily and freely with the application of only a small amount of force. In a preferred embodiment, the attachment member 14*a* is not biased toward either the vertical or horizontal position. In alternative embodiments, any suitably type of hinge that allows the attachment member to freely rotate back and forth may be utilized. As shown in FIG. 7, the threaded member 13 is preferably attached to an attachment element 11 that is compatible with one of the attachment elements 4, 6, 7 of the base 20. The attachment element 11 preferably has a squared shape with a hollow interior and is sized to fit over one of the attachment elements 4, 6, 7 of the base 20. Alternatively, attachment element 11 may have a threaded connection compatible with threads on the attachment elements 4, 6, 7 on the base 20. Once attachment element 11 has been positioned over attachment element 6, for instance, the first training attachment 14 may be secured to attachment element 6 by a thumb screw 12, as best seen in FIG. 7, or any other type of fastener suitable for securing the components together.

In a preferred embodiment, the apparatus further comprises a second training attachment 19, which is preferably configured to removably secure to one of the attachment elements 4, 6, 7 of the base 20. The second training attachment 19 comprises a generally vertical attachment member secured to one of the attachment elements 4, 6, 7 of the base 20 at a proximal end and having a tee 19*d* attached to a distal end. The tee 19*d* is configured to support a ball on the tee, as shown in FIGS. 8-10. In a preferred embodiment, the vertical attachment member of the second training attachment 19 comprises telescoping tubes 19*a*, 19*b*, and 19*c*, as shown in FIG. 1, for adjusting the height of the tee 19*d* for different users of the apparatus, as well as being collapsible for ease of breakdown and transport. Alternatively, the vertical attachment member may have only two telescoping tubes, as shown in FIGS. 8-10. In another alternative embodiment, the vertical attachment member may be formed from a single member having a fixed length. The tubes may have a square cross-sectional area, as best seen in FIG. 8, or alternatively a circular cross-sectional area, as shown in FIG. 1.

As shown in FIGS. 8-10, the training apparatus may be utilized with one or more of the second training attachments 19. FIG. 8 shows the apparatus positioned over home plate with the second training attachment 19 secured to the center attachment element 6 such that the ball is positioned over the center of the plate. FIG. 9 shows the apparatus with two training attachments 19 secured to attachment elements 4 and 7, respectively, so that two balls are positioned over an inside part of the plate and an outside part of the plate. FIG. 10 shows the apparatus with three training attachments 19 secured to each of the attachment elements 4, 6, 7, respectively, so that balls are positioned over the inside, outside, and middle parts of the plate. Thus, the apparatus may be used in hitting drills to practice hitting balls over different parts of the plate as a batter typically sees during a baseball or softball game while the batter remains in the same batting position relative to the plate and without the necessity of moving the apparatus.

In addition, when positioned over home plate, the apparatus as shown in FIG. 9, with two training attachments 19 secured to the base 20 over the inside and outside parts of the plate, may be used to practice additional batting accuracy techniques by allowing the batter to strike the ball placed atop one tee, as well as the ball atop the second tee, in a single, properly executed swing. The same technique may be utilized with three tees 19*d*, as shown in FIG. 10. This technique may help a batter practice maintaining a level swing when executing a swinging motion. Thus, the present training apparatus provides a number of options for ball placement for batting practice by configuring the apparatus to present balls in at least three positions at which a ball may cross the strike zone, including the outer area of the strike zone, the middle area of the strike zone, and the inner area of the strike zone. The user may then practice hitting a ball in at least one of these areas of the strike zone.

In a preferred embodiment, the apparatus further comprises a third training attachment 21, which is preferably configured to removably secure to one of the attachment elements 4, 6, 7 of the base 20. The third training attachment 21 comprises a generally vertical attachment member 16 secured to the attachment element at a proximal end and having a horizontal target positioning member 17 attached to a distal end. The target positioning member 17 has at least one target 18 attached thereto, and preferably has a plurality of targets 18 attached to the target positioning member 17. In a preferred embodiment, as shown in FIG. 11, the target positioning member 17 has two targets 18 attached to each of two opposing ends of the target positioning member 17 for a total of four targets for a pitcher to attempt to hit throwing a baseball. In this embodiment, the base 20 may be positioned over home plate so that the four targets 18 are positioned over four respective areas of the strike zone: high and inside, low and inside, high and outside, and low and outside, for example, depending on whether the pitcher is throwing to a left-handed or a right-handed batter. The apparatus may then be used by pitchers to practice pitching technique and accuracy in executing a variety of pitches intended to cross the plate at various areas within the strike zone. FIG. 1 illustrates an alternative embodiment having only one target 18.

The vertical attachment member 16 may be secured to any one of attachment elements 4, 6, or 7. In a preferred embodiment, as shown in FIG. 11, the vertical attachment member 16 comprises telescoping tubes 16*a* and 16*c* to adjust the height of the laterally oriented target positioning member 17. The attachment member 16 preferably also comprises a retaining device 16*b* configured to slidably retain the telescoping tubes 16*a* and 16*c* in a fixed position relative to each other once the height of the target positioning member 17 has been adjusted for a desired vertical positioning of the targets 18. In a preferred embodiment, the target positioning member 17 also comprises telescoping tubes so that the horizontal positioning of the targets 18 may also be adjusted for maximum flexibility in positioning the targets 18 over different areas of the plate or even off the plate outside of the strike zone. The target positioning member 17 may comprise a center tube element 17*a* that may be secured to the distal end of the vertical attachment member 16 and two opposing telescoping tubes 17*c* each slidably disposed within one respective opposing end of the center tube element 17*a*. Thus, the distance between the vertical attachment member 16 and the targets 18 on either the left or ride side of the member 16 may be independently adjusted by sliding one or both of the telescoping tubes 17*c* to a desired positioning. The target positioning member 17 preferably also comprises a retaining device 17*b* configured to slidably retain each of the opposing telescoping tubes 17*c* in a fixed position relative to the center tube element 17*a* once the horizontal positioning of the targets 18 has been adjusted as desired.

The target positioning member 17 is preferably positioned perpendicularly to the base member 1 and extends on either side of the vertical attachment member 16 as shown in FIG. 11. The telescoping tubes 17*c* each preferably have vertical extensions 25 extending upwardly and downwardly when secured to the center tube element 17*a* with one target 18 attached to each of the upwardly and downwardly extending extensions 25. However, other configurations of the target positioning member 17 may be utilized, which may include different configurations of the target positioning member 17 as well as additional attachment points for additional targets to allow for greater variation in the positioning of pitching targets. In addition, the target positioning member 17, including the extensions 25 to which the targets 18 are attached, may alternatively be bendable to allow maximum flexibility in positioning the targets 18. In a preferred embodiment, each target 18 is preferably positioned perpendicularly to the base member 1, which may provide added stability to the apparatus when a target 18 is hit with a ball thrown by a pitcher. Additionally, in a preferred embodiment, the third training attachment 21 may include springs 26 at the point of attachment of each target 18 to the target positioning member 17, as shown in FIG. 11. The springs 26 may absorb some of the force of contact caused by pitched balls hitting the targets 18 to further aid in stability of the apparatus.

It is understood that versions of the present disclosure may come in different forms and embodiments. Additionally, it is understood that one of skill in the art would appreciate these various forms and embodiments as falling within the scope of the invention as disclosed herein.

What is claimed is:

1. A training apparatus comprising:

a base; and a training attachment mounted on the base, wherein the training attachment comprises an elongated attachment member pivotally mounted on a hinge at a proximal end and having a contact element attached to a distal end, wherein the training attachment is configured to retain the attachment member in a generally vertical position when the attachment member is moved to the vertical position, wherein the attachment member is pivotable in a downward direction from the vertical position, wherein the contact element comprises a generally flat planar element that is positioned vertically when the attachment member is in the vertical position, wherein the contact element is positioned at a height horizontally aligned with a knee of a leg of a user, and wherein the hinge is designed to allow the attachment member to pivot downward upon a force being applied to the contact element and being generated by movement of the knee of the user caused by a swinging motion of the user.

2. The apparatus of claim 1, wherein the contact element is covered in padding.

3. The apparatus of claim 1, wherein the elongated attachment member has an adjustable length such that the height of the contact element above the base is adjustable.

4. The apparatus of claim 1, wherein the attachment member is pivotable in a downward direction from the vertical position only within a defined angle of rotation.

5. The apparatus of claim 1, wherein the hinge comprises a threaded member having male threads that are threaded into a threaded opening having corresponding female threads.

6. A method of sports training, said method comprising the steps of:

providing a training apparatus comprising:

a base, and a training attachment mounted on the base, wherein the training attachment comprises an elongated attachment member pivotally mounted on a hinge at a proximal end and having a contact element attached to a distal end, wherein the training attachment is configured to retain the attachment member in a generally vertical position when the attachment member is moved to the vertical position, wherein the attachment member is pivotable in a downward direction from the vertical position;

moving the attachment member to the vertical position;

a user standing in a batting stance, with a front leg of the user positioned on a front side of the contact element and a back leg of the user positioned on a back side of the contact element; and swinging a bat such that the user's back leg contacts the contact element, thereby causing the attachment member to pivot in a downward direction from the vertical position.

7. The method of claim 6, wherein the elongated attachment member has an adjustable length such that the height of the contact element above the base is adjustable, wherein the method further comprises the step of adjusting the height of the contact element so that the contact element is horizontally aligned with the knee of the user's back leg.

8. The method of claim 6, wherein the contact element is covered in padding.

* * * * *